United States Patent [19]

Shankel et al.

[11] 3,942,797

[45] Mar. 9, 1976

[54] STRING-PEG GAME

[75] Inventors: John C. Shankel; Marilou Shankel, both of San Francisco, Calif.

[73] Assignee: Lawrence Peska Associates, Inc., New York, N.Y. ; a part interest

[22] Filed: Mar. 14, 1975

[21] Appl. No.: 558,331

[52] U.S. Cl. ..... 273/97 R; 46/1 G

[51] Int. Cl.[2] ..... A63B 71/02

[58] Field of Search ..... 46/61–63, 1 G; 272/67; 273/95 A, 97 R, 98

[56] References Cited

UNITED STATES PATENTS

| | | | |
|---|---|---|---|
| 2,475,656 | 7/1949 | Bidak | 272/67 |
| 2,579,022 | 12/1951 | Spencer | 46/61 |
| 2,891,351 | 6/1959 | Madaras | 46/61 |
| 3,624,958 | 8/1970 | Salayka | 46/61 |
| 3,806,121 | 4/1974 | Crossely | 272/67 |
| 3,858,348 | 1/1975 | Brown | 46/61 |

*Primary Examiner*—Richard C. Pinkham
*Assistant Examiner*—Marvin Siskind
*Attorney, Agent, or Firm*—Richard E. Nanfeldt

[57] ABSTRACT

A string peg game comprises a circular disc member having an annular groove in a longitudinal sidewall of the disc member. A cylindrical handle member extends outward from one end of the disc member and a cylindrical peg member extends outward from the other end of the disc member. An elongated string member is secured into the annular groove. The user holds the member with his left hand and the free end of the string member with his right hand. The user flicks the string and attempts to lasso the peg member with the string member.

3 Claims, 3 Drawing Figures

STRING-PEG GAME

SUMMARY OF THE INVENTION

Our present invention relates to a unique and novel string peg game, wherein a user attempts to lasso a peg member with a string member.

A number of U.S. Pat. Nos. 568,792; 978,720; and 1,514,089 have employed string games, but these aforementioned patents are non-applicable to our present invention.

An object of our present invention is to provide a string game universally acceptable for all age groups, wherein the game serves as a means of teaching manual dexerity, as well as being a form of entertainment.

A further object of our present invention is to provide a string peg game, wherein the game is formed from one integral unit.

A still further object of our present invention is to provide a string peg game of simple design and relatively low manufacturing cost.

Briefly, our present invention comprises a circular disc member having an annular groove in a longitudinal sidewall of the disc member. A cylindrical handle member extends outwards from one end of the disc member and a cylindrical peg member extends outward from the other end of the disc member. An elongated string member is secured into the annular groove. The user holds the member with his left hand and the free end of the string member with his right hand. The user flicks the string and attempts to lasso the peg member with the string member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
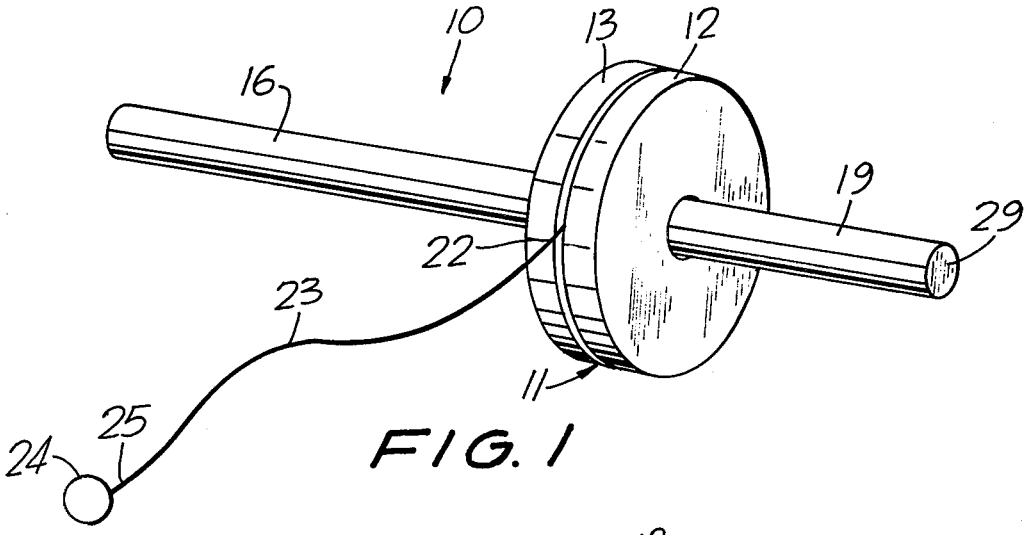
FIG. 1 illustrates a perspective view of a string peg game.
Figure 2:
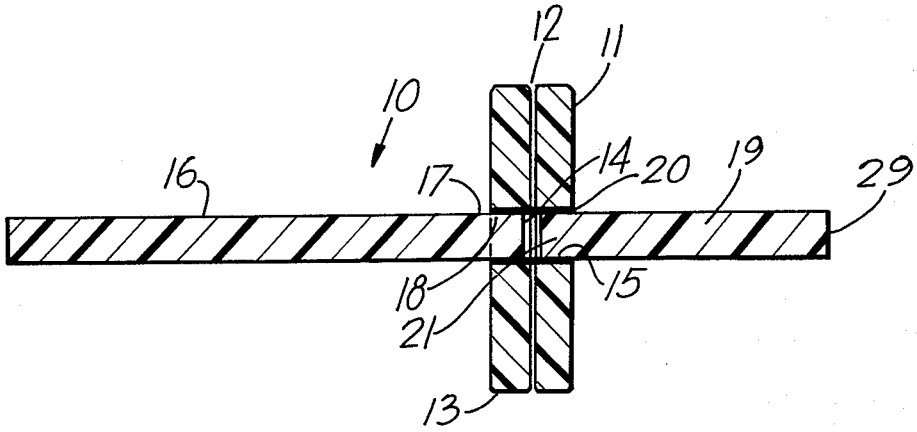
FIG. 2 illustrates a side cross sectional view of the string peg game.

Turning now descriptively to the drawings, in which similar reference characters denote similar elements throughout the several views, FIGS. 1–2 show a string peg game 10 comprising a circular disc member 11 having an annular central grove 12 in a periphery 13 of the disc member 11. The disc member 11 has a central longitudinal bore 14 continuous therethrough, wherein the bore 14 has a threaded surface 15 thereon. One end 17 of an elongated cylindrical shaped handle member 16 has a threaded outside surface 18, wherein the one end 17 of the handle member threadably engages one end of bore 14. One end 20 of an elongated cylindrical shaped peg member 19 has a threaded external surface 21, wherein end 20 threadably engages the other end of bore 14. One end 22 of an elongated string member 23 is secured within grove 12. A ring member 24 is secured to the other end 25 of string member 23. The length of the handle member 16 exceeds the length of the peg member 19.

Figure 3:
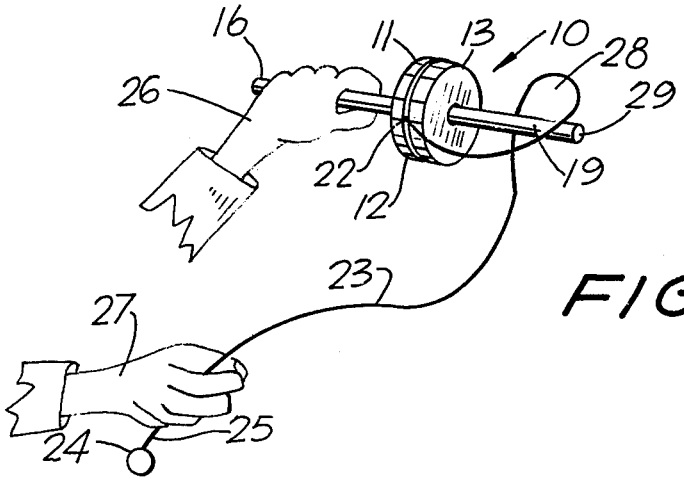
FIG. 3 illustrates a perspective view of the string peg game in use.

As shown in FIG. 3, the user grasps the handle member 16 with his left hand 26, while the user's right hand 27 grasps the end 25 of the string member 23. The user flicks the string member 23 causing a loop 28 to form in the string member 23. As the loop 28 advances towards the free end 29 of the peg member 19, the user attempts to lasso the peg member. A plurality of variations can be used in the game 10 such as the length of time required to lasso the peg member 19 or the most number of consecutive lassos made on the maximum number of lassos in a given length of time. The user can also hold the peg member 19 and attempt to lasso the handle member 16 which is easier due to the longer length of the handle member 16.

The game 10 can be formed from metal, wood or plastic formed from the group consisting of polyethylene, polypropylene, polyvinyl chloride, polystryene, and nylon.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what we claim as new and desire to secure by Letters Patent of the United States is:

1. A string game, which comprises:

a. a circular disc member having a threaded longitudinal center bore continuous therethrough;

b. an elongated string member communicating with said disc member;

c. a cylindrically shaped peg member having an externally threaded surface at one end thereof, said one end of said peg member threadably engaged into said bore of said disc member, said peg member extending outwardly from one side of said disc member;

d. a cylindrically shaped handle member having an externally threaded surface at one end thereof, said one end of said handle member threadably engaged into said bore of said disc member, said handle member extending outwardly from another side of said disc member, said handle member being longer than said peg member; and e. a ring member affixed onto a free end of said string member whereby the user may hold the handle with one hand and the free end of the string with his other hand and thin flick the string in an attempt to lasso the peg with the string.

2. A string peg game as recited in claim 1, wherein a said disc member periphery has an annular grove therein, and one end of said string member being affixed within said annular grove.

3. A string peg game, according to claim 1, wherein said disc member, said handle member and said peg member are formed from a thermoplastic material.

* * * * *